US008506795B2

(12) United States Patent
Palmas et al.

(10) Patent No.: US 8,506,795 B2
(45) Date of Patent: Aug. 13, 2013

(54) PROCESS FOR FLUID CATALYTIC CRACKING

(75) Inventors: Paolo Palmas, Des Plaines, IL (US); Robert L. Mehlberg, Wheaton, IL (US); Laura E. Leonard, Western Springs, IL (US)

(73) Assignee: UOP LLC, Des Plaines, IL (US)

( * ) Notice: Subject to any disclaimer, the term of this patent is extended or adjusted under 35 U.S.C. 154(b) by 509 days.

(21) Appl. No.: 12/794,187

(22) Filed: Jun. 4, 2010

(65) Prior Publication Data

US 2011/0297583 A1 Dec. 8, 2011

(51) Int. Cl.
*C10G 11/00* (2006.01)

(52) U.S. Cl.
USPC ..... 208/113

(58) Field of Classification Search
USPC ..... 208/62, 113; 502/41
See application file for complete search history.

(56) References Cited

U.S. PATENT DOCUMENTS

| | | | | |
|---|---|---|---|---|
| 3,857,794 | A | 12/1974 | Carey | |
| 3,966,587 | A | 6/1976 | Bittensky et al. | |
| 3,990,992 | A | 11/1976 | McKinney | |
| 4,444,722 | A | 4/1984 | Owen | |
| 4,595,567 | A | 6/1986 | Hedrick | |
| 5,294,332 | A | 3/1994 | Klotz | |
| 5,310,477 | A | 5/1994 | Lomas | |
| 6,039,863 | A | 3/2000 | Palmas | |
| 7,011,740 | B2 | 3/2006 | Tallman et al. | |
| 7,261,807 | B2 | 8/2007 | Henry et al. | |
| 7,312,370 | B2 | 12/2007 | Pittman et al. | |
| 7,435,331 | B2 | 10/2008 | Peterson et al. | |
| 2001/0000600 | A1 | 5/2001 | Ito et al. | |
| 2001/0025806 | A1 * | 10/2001 | Steffens et al. | 208/113 |
| 2004/0069681 | A1 * | 4/2004 | Peterson et al. | 208/113 |
| 2008/0035527 | A1 | 2/2008 | Eng et al. | |
| 2008/0153689 | A1 | 6/2008 | Towler et al. | |
| 2010/0004118 | A1 | 1/2010 | Liu et al. | |
| 2011/0257005 | A1 * | 10/2011 | Niccum | 502/41 |

OTHER PUBLICATIONS

U.S. Appl. No. 12/340,291, filed Dec. 19, 2008, by Mehlberg, entitled, "Fluid Catalytic Cracking System and Process".
U.S. Appl. No. 12/344,598, filed Dec. 29, 2008, by Mehlberg et al., entitled, "Fluid Catalytic Cracking System and Process".
U.S. Appl. No. 12/771,755, filed Apr. 30, 2010, by Myers et al., entitled, "Process for Regenerating Catalyst in a Fluid Catalytic Cracking Unit".
Bulkley, "Torch Oil for Cat Cracker Startup", "The Oil and Gas Journal", Sep. 11, 1961, vol. 59, No. 37, pp. 118 and 120.
Hennings, "Start Cat Crackers Quickly, Safely and Friendly", "World Refining", Mar. 2000, vol. 10, No. 2, pp. 24-28.
Leunberger et al., "Octane Catalyst Effects on Heat of Cracking and Coke Make", "Summary of paper presented at National Petroleum Refiners Assn. 1987 Annual Meeting", pp. 5 pages.

* cited by examiner

*Primary Examiner* — Randy Boyer
*Assistant Examiner* — Juan Valencia
(74) *Attorney, Agent, or Firm* — James C. Paschall

(57) ABSTRACT

One exemplary embodiment can be a process for fluid catalytic cracking. The process may include providing a torch oil to a stripping section of a first reaction zone, which in turn can communicate at least a partially spent catalyst to a regeneration zone for providing additional heat duty to the regeneration zone.

20 Claims, 1 Drawing Sheet

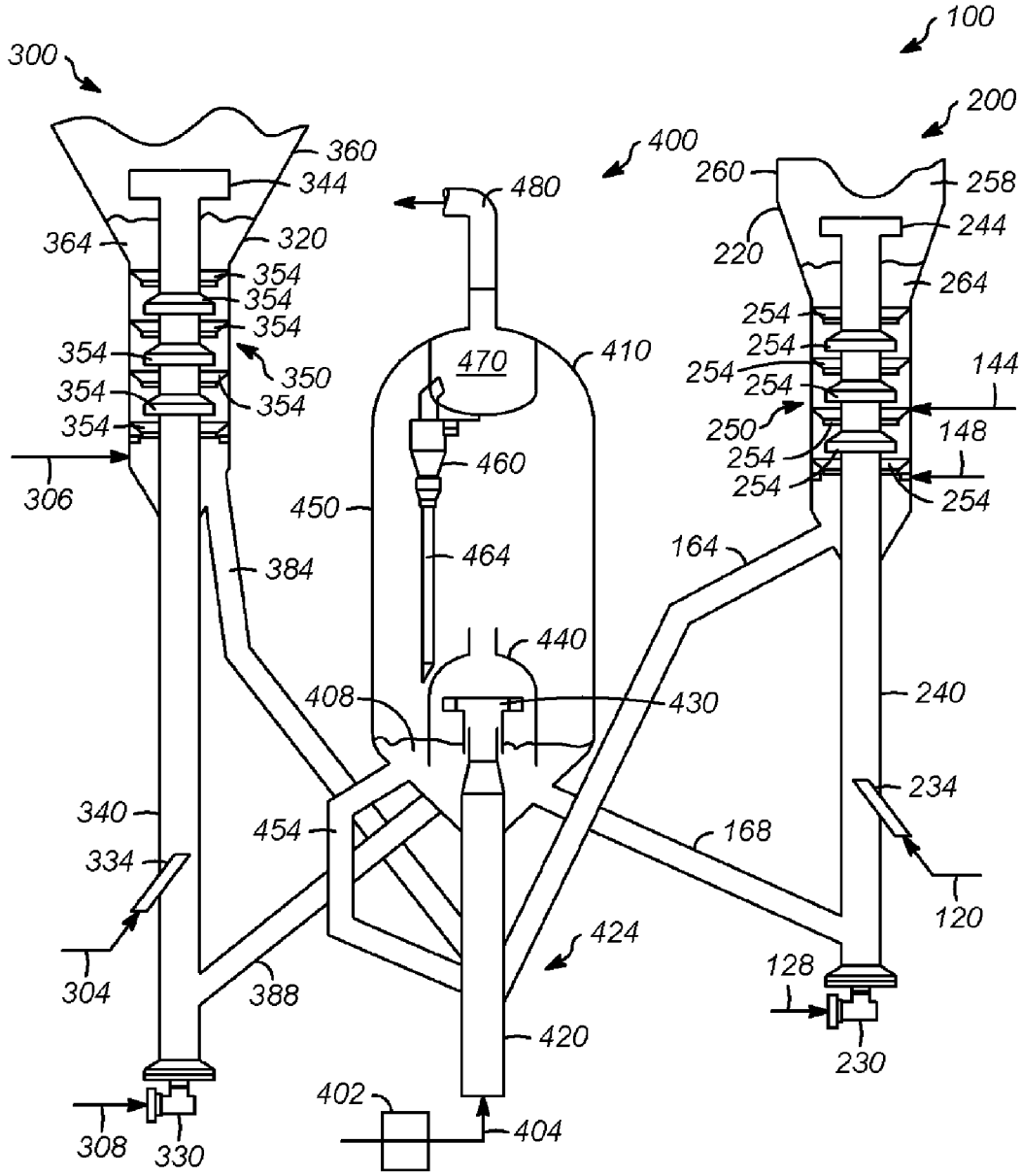
100
200
300
400
360
344
480
260
258
364
320
220
244
354
264
350
470
410
144
306
460
250
148
450
464
164
384
440
408
430
240
234
340
454
168
334
120
424
304
388
128
420
230
402
404
308
330

PROCESS FOR FLUID CATALYTIC CRACKING

FIELD OF THE INVENTION

This invention generally relates to a process for fluid catalytic cracking.

DESCRIPTION OF THE RELATED ART

Fluid catalytic cracking can create a variety of products from heavier hydrocarbons. Often, a feed of heavier hydrocarbons, such as a vacuum gas oil, is provided to a fluid catalytic cracking reactor. Various products may be produced, including a gasoline product and/or another product, such as at least one of propylene and ethylene.

Sometimes, fluid catalytic cracking (may be abbreviated as "FCC") units operate with feeds having low sulfur and relatively shorter carbon chain lengths, such as hydrotreated vacuum gas oil feed stocks, which can be referred to as "clean" feeds. Processing such clean feeds may create operating challenges due to low regenerator temperatures, which may be a result of the lack of coke on the spent catalyst. Thus, the regenerator can have insufficient heat and run at lower than desired temperatures. As such, catalyst regeneration difficulties may arise that can impact product quality.

One possible remedy for the lack of heat duty in the regenerator is injecting torch oil directly into the regenerator. However, injecting the torch oil directly into the regenerator can result in localized hot spots resulting in catalyst deactivation. Thus, it would be desirable to provide an FCC process that can process clean feeds without having the adverse effects, as discussed above.

SUMMARY OF THE INVENTION

One exemplary embodiment can be a process for fluid catalytic cracking. The process may include providing a torch oil to a stripping section of a first reaction zone, which in turn can communicate at least a partially spent catalyst to a regeneration zone for providing additional heat duty to the regeneration zone.

Another exemplary embodiment may be a process for fluid catalytic cracking. The process can include providing a torch oil to a stripping section of a first reactor to a combustor of a regeneration vessel to add heat duty to the regeneration vessel.

Yet a further exemplary embodiment can be a process for fluid catalytic cracking. Generally, the process includes providing a light hydrocarbon feed to a first reactor including a stripping section; providing a heavy hydrocarbon feed to a second reactor; communicating a catalyst from the first and second reactors to a regeneration zone; and providing a torch oil to the stripping section of the first reactor to add heat duty to the regeneration zone.

The embodiments disclosed herein can provide the requisite heat duty for a regeneration vessel by injecting torch oil into a stripping section of a reactor receiving a feed of light hydrocarbons. As such, the torch oil can be dispersed in the stripping section using, preferably, minimal steam. Typically, only sufficient air is required to burn the coke and torch oil that, in turn, can minimize the volume of gas and correspondingly optimize the size of the vessel, vortex separating system, and cyclones in the regenerator. As such, the heat duty that may not be sufficient due to the insufficient coking of catalyst in the reactor can be supplemented by the addition of torch oil into the stripping section.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Furthermore, a superscript "+" or "−" may be used with an abbreviated one or more hydrocarbons notation, e.g., $C3^{+}$ or $C3^{-}$, which is inclusive of the abbreviated one or more hydrocarbons. As an example, the abbreviation "$C3^{+}$" means one or more hydrocarbon molecules of three carbon atoms and/or more.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones. The term "section" may be used interchangeably with the term "zone".

As used herein, the term "rich" can mean an amount of at least generally about 50%, and preferably about 70%, by mole, of a compound or class of compounds in a stream.

As used herein, the term "substantially" can mean an amount of at least generally about 80%, preferably about 90%, and optimally about 99%, by mole, of a compound or class of compounds in a stream.

As used herein, the term "partially spent catalyst" can include partially or fully spent catalyst.

BRIEF DESCRIPTION OF THE DRAWING

FIG. 1 is a schematic depiction of an exemplary fluid catalytic cracking apparatus.

DETAILED DESCRIPTION

Referring to FIG. 1, an exemplary fluid catalytic cracking apparatus 100 is depicted. In the drawings, the terms lines, oils, mediums, feeds, and streams can be used interchangeably. Generally, the fluid catalytic cracking apparatus 100 can include a first reaction zone 200, a second reaction zone 300, and a regeneration zone 400, including a regeneration vessel 410.

The first reaction zone 200 can include a first reactor 220. In this depiction, only a portion of the first reactor 220 is depicted. Particularly, the upper portions of a separation section 258 are omitted, such as one or more cyclone separators and a plenum for receiving product gases. Such a separation section is depicted in, e.g., U.S. Pat. No. 5,310,477.

The first reactor 220 can include a distributor 230, a riser 240, a stripping section 250, and a shell 260. Optionally, the distributor 230 can receive a lift gas stream 128, which is typically nitrogen, steam, or one or more C2-C4 hydrocarbons. Generally, a feed 120 of one or more light hydrocarbons, such as a light cracked naphtha, can be provided to another distributor 234 at a higher elevation on the riser 240. Typically, the light hydrocarbons can include one or more C4-C7 hydrocarbons. Moreover, the feed of the light hydrocarbons can be provided alternatively or additionally than the distributor 234 by combining the feed with the lift gas stream 128 and providing the mixture at the distributor 230. The light hydrocarbon feed 120 can pass into the riser 240 and be combined with a regenerated catalyst provided via a line 168, as hereinafter described. The mixture of light hydrocarbons, catalyst and lift gas can travel up the riser 240 to any suitable separation device, such as a pair of swirl arms 244.

The swirl arms 244 can separate a majority of the catalyst from the cracked hydrocarbon gases. Catalyst removed by the swirl arms 244 can fall to a catalyst bed 264. The product gases can pass upward into cyclone separators where further separation of the cracked product gases from the catalyst can occur with additional catalyst dropping down via dip legs to the catalyst bed 264. Typically, the product gases pass upward and out of the first reaction zone 200 to downstream processes, such as one or more fractionation towers, to be separated into the various products.

Usually, catalyst cascades downward from the catalyst bed 264 into the stripping section 250. Preferably, the stripping section 250 has one or more baffles 254 that project transversely across the stripping section 250. In this exemplary embodiment, seven baffles 254 are depicted, although any number of baffles 254 may be utilized. As the catalyst falls through the baffles 254, a stripping medium, such as steam, can be provided and rise counter-currently. This counter-current contacting can enhance the stripping of the adsorbed components from the surface of the catalyst. The catalyst can generally be considered spent or at least partially spent.

In addition, a torch oil 144 can be provided to the stripping section 250 as well. The torch oil 144 can include at least one of a light cycle oil (may be abbreviated "LCO"), a heavy cycle oil (may be abbreviated "HCO"), a clarified slurry oil (may be abbreviated "CSO"), and an FCC feed. The boiling points for LCO and HCO may be determined by ASTM D86-09e1 and for CSO and FCC feed may be determined by ASTM D1160-06. The specific torch oils can have the following boiling points as depicted in the following table:

TABLE 1

(All Values in Degrees Celsius and Rounded to Nearest 10)

| | LCO | HCO | CSO | FCC Feed |
|---|---|---|---|---|
| Initial Boiling Point | 220 | 150 | 260 | 180 |
| 10% | 240 | 340 | 340 | 360 |
| 30% | 260 | 360 | 380 | 440 |
| 50% | 280 | 370 | 420 | 490 |
| 70% | 300 | 370 | 470 | 540 |
| 90% | 320 | 400 | 530 | 600 |
| End Point | 340 | 440 | 550 | 620 |

Generally, the torch oil 144 provided to the stripping section 250 will be dispersed using any suitable amount of a fluidizing or stripping medium 148, such as steam. Typically, the amount of steam can be minimized to ensure proper dispersion of the torch oil without incurring problems, such as localized hot spots in the regeneration vessel 410 due to undispersed torch oil combusting and creating isolated hot points in the regeneration zone 400. As such, the air required to combust the coke from the catalyst and the injected torch oil 144 can be minimized and therefore prevent unnecessary capital expenditures to purchase larger equipment, such as compressors, to process larger air flows.

After the catalyst drops through the stripping section 250, the spent catalyst can pass through a line 164 to the regeneration zone 400. Typically, the catalyst utilized in the first reaction zone 200 can be any suitable catalyst, such as an MFI zeolite or a ZSM-5 zeolite. Alternatively, a mixture of a plurality of catalysts, including an MFI zeolite and a Y-zeolite, may be used. Exemplary catalyst mixtures are disclosed in, e.g., U.S. Pat. No. 7,312,370 B2.

The second reaction zone 300 can include a reactor 320. The reactor 320 is only partially depicted, and can include a separation section for separating the catalysts from one or more gas cracked products. The reactor 320 may further include a distributor 330, a riser 340, a stripping section 350, a shell 360, and a catalyst bed 364. Exemplary reaction vessels are disclosed in, e.g., U.S. Pat. No. 7,261,807 B2; U.S. Pat. No. 7,312,370 B2; and US 2008/0035527 A1.

Although the reactor 320 is a riser reactor as depicted, it should be understood that any suitable reactor or reaction vessel can be utilized, such as a fluidized bed reactor or a fixed bed reactor. Typically, the reactor 320 can include the riser 340 terminating in the shell 360. The riser 340 can receive a feed 304 that can have a boiling point range of about 180-about 800° C. at a higher elevation on the riser 340 via another distributor 334. Typically, the feed 304 can be at least one of a gas oil, a vacuum gas oil, an atmospheric gas oil, and an atmospheric residue. Alternatively, the feed 304 can be at least one of a heavy cycle oil and a slurry oil, and is generally heavier than the feed 120.

Optionally, the distributor 330 can receive a lift gas stream 308, which is typically nitrogen, steam, or one or more C2-C4 hydrocarbons, and can be the same or different as the lift gas stream 128. Generally, the feed 304 enters the riser 340 and is combined with a regenerated catalyst provided via a line 388, as hereinafter described. Moreover, the heavy feed can be provided alternatively or additionally than the another distributor 334 by combining the feed with the lift gas stream 308 and adding the mixture at the distributor 330. The mixture of one or more hydrocarbons, catalyst, and lift gas can travel up the riser to any suitable separation device, such as a pair of swirl arms 344.

The swirl arms 344 can separate a majority of the catalyst from the cracked hydrocarbon gases. Catalyst removed by the swirl arms 344 can fall to a catalyst bed 364. The product gases can pass upward into cyclone separators where further separation of the cracked product gases from the catalyst can occur with additional catalyst dropping down via dip legs to the catalyst bed 364. Typically, the product gases pass upward and out of the second reaction zone 300 to downstream processes, such as one or more fractionation towers, to be separated into the various products.

Usually, catalyst cascades downward from the catalyst bed 364 into the stripping section 350. Preferably, the stripping section 350 has one or more of baffles 354 that project transversely across the stripping section 350. In this exemplary embodiment, seven baffles 354 are depicted, although any number of baffles 354 may be used. As the catalyst falls through the baffles 354, a stripping medium 308, such as steam, can be provided and rise counter-currently. This counter-current contacting can enhance the stripping of the adsorbed components from the surface of the catalyst. Typically, the catalyst in the second reaction zone 300 has sufficient coke for providing the heat of regeneration to regenerate this volume of catalyst alone due to cracking heavier feeds than the first reaction zone 200.

After the catalyst drops through the stripping section 350, the spent or partially spent catalyst can pass through a line 384 to the regeneration zone 400. Typically, the catalyst utilized in the second reaction zone 300 can be any suitable catalyst, such as Y zeolite optionally with an MFI zeolite or a ZSM-5 zeolite. Exemplary catalyst mixtures are disclosed in, e.g., U.S. Pat. No. 7,312,370 B2.

The regeneration zone 400 can include a regeneration vessel 410. The regeneration vessel 410 can be any suitable vessel, such as those disclosed in, e.g., U.S. Pat. No. 7,261,807 B2; U.S. Pat. No. 7,312,370 B2; and US 2008/0035527 A1.

Generally, the regeneration vessel 410 can include a heater 402, a combustor 420, a chamber 440, a shell 450, one or more cyclone separators 460, and a plenum 470. Typically, a stream 404, including oxygen, can be provided to the heater 402. Usually, the oxygen-containing stream 404 includes air. The heater 402 may be a direct fired heater that can heat the stream 404 at start-up and optionally at steady-state conditions. The stream 404 can be provided to the combustor 420 where it can be combined with spent catalyst in the lines 384 and 164. As discussed above, the spent catalyst in the line 164 can be combined with torch oil. The residual coke on the catalyst and the entrained torch oil can be burned in the combustor 420 to provide the requisite heat for regeneration. Generally, the catalyst rises to arms 430 where the combustion product gases are separated from the catalyst, which in turn can fall to a catalyst bed 408.

Usually, the combustor 420 terminates with a vortex separation system disengager with a single stage of regenerator cyclones. The disengaging section may be designed for a lower velocity consistent with state of design practice. To accelerate the combustion rate in the riser, the combustion air may be preheated, for example, by firing the heater 402 or utilizing a recirculating catalyst line 454 to provide catalyst from the catalyst bed 408 to or proximate to a base 424 of the combustor 420 of the regeneration vessel 410. However, the heater 402 and recirculating catalyst line 454 are optional and can be omitted if sufficient heat is provided by adding torch oil to the stripping section 250 and optionally combusting the coke present on the catalyst. Regenerated catalyst may be provided to the first reaction zone 200 via the line 168, or provided to the second reaction zone 300 via the line 388.

Afterwards, the combustion gases can rise within the shell 450 after exiting the chamber 440 and enter one or more cyclone separators 460. Any entrained catalyst particles can fall via a dip leg 464 back to the catalyst bed 408. Although one dip leg 464 is depicted, any suitable number of dip legs may be utilized. Combustion gases can rise into a plenum 470 and exit an outlet line 480. Typically, it is desirable for the regeneration vessel 410 to operate at a sufficient temperature to regenerate, yet not damage the catalyst, such as a temperature of about 590-about 760° C. By adding the torch oil to the catalyst at the stripping section 250 of the first reaction zone 200, the requisite heat of regeneration may be provided.

As such, the embodiments disclosed herein provide the means of processing C4 hydrocarbons and naphtha in a second FCC riser. Although the comingling of catalyst is depicted, it should be understood that the first reaction zone 200 can be utilized solely with the regeneration zone 400 without comingling catalyst from other reaction zones. As such, the first reaction zone 200 can have its own dedicated regeneration zone 400.

Thus, the embodiments disclosed herein can minimize the size of the catalyst heating equipment, and more importantly, reduce catalyst deactivation by curtailing catalyst exposure to high temperatures from a burner, a flame, or a torch oil directly exposed or injected into the regeneration vessel 410. By dispersing the torch oil into the stripping section 250, the stripped catalyst, now with adsorbed torch oil, can be directed to the combustor 420 optionally designed for a low residence time and a high velocity, such as about 0.9-about 3 meter per second, in order to minimize the catalyst hold-up. Moreover, injecting the torch oil in the stripping section 250 can enhance a mixture of the torch oil with the catalyst to avoid localized accumulation of torch oil that can create undesired hot spots in the regeneration zone 400.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for fluid catalytic cracking, comprising:

A) providing a torch oil to a stripping section of a first reaction zone, which in turn communicates at least a partially spent catalyst to a regeneration zone for providing additional heat duty to the regeneration zone.

2. The process according to claim 1, wherein the stripping section further receives steam.

3. The process according to claim 1, wherein the stripping section comprises one or more baffles.

4. The process according to claim 3, wherein the torch oil comprises at least one of a light cycle oil, a heavy cycle oil, a clarified slurry oil, and an FCC feed.

5. The process according to claim 1, wherein the catalyst comprises an MFI zeolite.

6. The process according to claim 1, wherein the regeneration zone further comprises a regeneration vessel, in turn, comprising a combustor.

7. The process according to claim 6, wherein the catalyst is communicated proximate to a base of the regeneration vessel.

8. The process according to claim 1, further comprising providing a light hydrocarbon feed to the first reaction zone.

9. The process according to claim 8, wherein the light hydrocarbon feed comprises a light cracked naphtha.

10. The process according to claim 1, further comprising a second reaction zone communicating with the regeneration zone.

11. A process for fluid catalytic cracking, comprising:

A) providing a torch oil to a stripping section of a first reactor to a combustor of a regeneration vessel to add heat duty to the regeneration vessel.

12. The process according to claim 11, further comprising providing air to the combustor.

13. The process according to claim 11, further comprising providing a light hydrocarbon feed to the first reactor.

14. The process according to claim 11, wherein the first reactor further comprises a riser.

15. The process according to claim 11, wherein a catalyst is provided proximate to a base of the regeneration vessel.

16. The process according to claim 11, wherein the regeneration vessel further comprises a shell, and the process further comprises providing a regenerated catalyst from the shell to the combustor.

17. The process according to claim 11, wherein the regeneration vessel comprises one or more cyclone separators.

18. The process according to claim 11, wherein the stripping section comprises one or more baffles.

19. The process according to claim 11, wherein the torch oil comprises at least one of a light cycle oil, a heavy cycle oil, a clarified slurry oil, and an FCC feed.

20. A process for fluid catalytic cracking, comprising:

A) providing a light hydrocarbon feed to a first reactor comprising a stripping section;

B) providing a heavy hydrocarbon feed to a second reactor;

C) communicating a catalyst from the first and second reactors to a regeneration zone; and D) providing a torch oil to the stripping section of the first reactor to add heat duty to the regeneration zone.

* * * * *